US009493258B2

(12) United States Patent
Olbrich et al.

(10) Patent No.: US 9,493,258 B2
(45) Date of Patent: Nov. 15, 2016

(54) METHOD AND PRODUCTION SYSTEM FOR PRODUCING AND/OR PACKAGING CIGARETTES

(75) Inventors: Hartmut Olbrich, Verden (DE); Michael Czarnotta, Bremen (DE); Hartmut Levers, Verden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 815 days.

(21) Appl. No.: 13/996,969

(22) PCT Filed: Nov. 4, 2011

(86) PCT No.: PCT/EP2011/005556

§ 371 (c)(1),
(2), (4) Date: Aug. 30, 2013

(87) PCT Pub. No.: WO2012/084089

PCT Pub. Date: Jun. 28, 2012

(65) Prior Publication Data

US 2014/0290180 A1 Oct. 2, 2014

(30) Foreign Application Priority Data

Dec. 22, 2010 (DE) ..... 10 2010 055 542

(51) Int. Cl.
*G06F 7/00* (2006.01)
*B65B 19/32* (2006.01)
(Continued)

(52) U.S. Cl.
CPC ..... *B65B 19/32* (2013.01); *B65B 19/02* (2013.01); *B65B 19/28* (2013.01); *B65B 57/00* (2013.01); *B65B 61/025* (2013.01)

(58) Field of Classification Search
None
See application file for complete search history.

(56) References Cited

U.S. PATENT DOCUMENTS 6,456,729 B1 9/2002 Moore
6,614,023 B2 * 9/2003 Focke ..... B65B 61/26 250/318
(Continued)

FOREIGN PATENT DOCUMENTS

CN 1639008 A 7/2005
CN 2801727 Y 8/2006
(Continued)

OTHER PUBLICATIONS

WIPO, International Search Report for priority PCT/EP2011/005556 (Mar. 28, 2012).
(Continued)

*Primary Examiner* — Yolanda Cumbess
(74) *Attorney, Agent, or Firm* — Laurence P. Colton; Smith Tempel Blaha LLC

(57) ABSTRACT

A method for producing and/or packaging cigarettes, in a system in which at least one production unit is fed packaging units from a lower packaging level, and the production unit packages the packaging units in associated packaging units from a higher level, and the packaging units from the higher packaging level each comprise one or more packaging units from the lower packaging level. A camera records images of the packs of the packaging units from the lower level which are to be fed, or have been fed, to the production unit, and a camera records images of the packs of the packaging units from the higher level which are respectively assigned to the packaging units from the lower level, and the recorded images of the packs of the respectively associated packaging units are each assigned to a common identifier, preferably to a machine-internal counting number of the production unit.

23 Claims, 3 Drawing Sheets

(51) Int. Cl.

| | |
|---|---|
| ***B65B 19/28*** | (2006.01) |
| ***B65B 57/00*** | (2006.01) |
| ***B65B 19/02*** | (2006.01) |
| ***B65B 61/02*** | (2006.01) |

(56) References Cited

U.S. PATENT DOCUMENTS

| | | | |
|---|---|---|---|
| 2005/0022470 | A1 | 2/2005 | Focke |
| 2006/0118437 | A1 | 6/2006 | Gosebruch |

FOREIGN PATENT DOCUMENTS

| | | | |
|---|---|---|---|
| CN | 101885391 | A | 11/2010 |
| DE | 19839852 | A1 | 9/1999 |
| DE | 10004022 | A1 | 8/2001 |
| DE | 10155780 | A1 | 5/2003 |
| DE | 10100248 | A1 | 10/2003 |
| DE | 102006019248 | A1 | 10/2007 |
| DE | 102009037626 | A1 | 2/2011 |
| DE | 102008062370 | A1 | 8/2011 |
| EP | 1459988 | A1 | 9/2004 |

OTHER PUBLICATIONS

Deutches Patent-Und Markenamt (German Patent and Trademark Office), Search Report on priority DE102010055542.8 (Sep. 23, 2011).

State Intellectual Property Office of the People's Republic of China, Notification of the First Office Action (for related Chinese Application No. 201180066684.X) (Jun. 4, 2014).

State Intellectual Property Office of the People's Republic of China, Search Report (on related application), Jun. 14, 2014.

* cited by examiner

METHOD AND PRODUCTION SYSTEM FOR PRODUCING AND/OR PACKAGING CIGARETTES

BACKGROUND OF THE INVENTION

1. Technical Field

The invention relates to a method for producing and/or packaging products, in particular cigarettes, in a production and/or packaging system in which at least one production unit of the system is fed packaging units from a lower packaging level, and the production unit packages said packaging units in associated packaging units from higher levels, such that the packaging units from the higher packaging level each comprise one or more packaging units from the lower packaging level.

2. Prior Art

It is becoming more and more important in the cigarette industry to allow for comprehensive retraceability of products (Track and Trace). In the future, for example, it may possibly be required by law that, for a certain commercially available cigarette pack, it may be required to give proof of the machines, times, materials, etc. involved in manufacturing said cigarette pack.

In addition, it may become necessary, if appropriate, to be able to indicate the specific packaging units from a higher packaging level in which said cigarette pack was packaged when it left the manufacturing facility. It is thus conceivable for it to be necessary to give proof of the cigarette multipack and/or the carton in which the pack was packaged and/or of the pallet on which it was shipped. The expression "to package", within the context of the present application, is intended to mean any assignment of a packaging unit from a lower level to a packaging unit from a higher level. In this way, it is possible, for example, for "cartons" packaging units to be packaged in a "pallet" packaging unit, on which the cartons are positioned. The packaging unit from the higher level need not necessarily spatially enclose the packaging unit from the lower level, even in part.

In order to achieve the aforementioned aim, EP 1 459 988 A1 proposes that codings, each carrying information regarding the contents contained in the packaging units, should be applied to the packs of the packaging units from the individual packaging levels. These codings here each carry information regarding the smaller packaging units contained within the packaging units.

For this purpose, the codings of the packaging units from the lower level are read out in the production process before the packaging units are fed to that production unit that packages said packaging unit from the lower level in the associated packaging unit from the higher level. Accordingly, the read-out codings are included as information in the generation of codings that are then applied to the packaging units from the higher level. This creates an assignment between the packaging units from different levels.

The disadvantage here, inter alia, is the fact that, with the high process speeds in the packaging industry, the operations of reading out the codings and, in particular, of analyzing and/or processing the read-out codings to give the codings that are to be applied to the packaging units from higher levels can only be realized with great difficulty. In addition, it is necessary for the codings on the packaging units from a higher level, which carry the information regarding the packaging units from a lower level, to be applied to the packaging units while the production process is underway. It is not possible to prefabricate, for example, multipack blanks with coding already applied.

BRIEF SUMMARY OF THE INVENTION

It is an object of the present invention to provide a method that is intended for producing and/or packaging products of the type mentioned in the introduction and by means of which it is possible, in as straightforward and efficient a manner as possible, to track products packaged in different packaging levels. It is a further object of the present invention to provide a production and/or packaging system that operates using such a method.

The object according to the invention is achieved by a method for producing and/or packaging products, in particular cigarettes, in a production and/or packaging system in which at least one production unit of the system is fed packaging units from a lower packaging level, and the production unit packages said packaging units in associated packaging units from a higher level, and therefore the packaging units from the higher packaging level each comprise one or more packaging units from the lower packaging level, characterized in that a camera records images of the packaging units, such as for example cigarette packs, from the lower level that are to be fed, or have already been fed, to the production unit, and a camera records images of the packaging units, such as for example cigarette multipacks and/or cartons, from the higher level that are respectively assigned to the packaging units from the lower level, and in that the recorded images of the respectively associated packaging units are each assigned to a common identifier, preferably to a machine-internal counting number of the production unit. The object according to the invention is achieved also by a production and/or packaging system for implementing the above method having at least one production unit that can be fed packaging units from a lower packaging level, which can be packaged, by the production unit, in associated packaging units from a higher level such that the packaging units from the higher packaging level comprise one or more packaging units from the lower packaging level, which goes before in the packaging process, characterized by a camera, which can record images of the packaging units from the lower level that are to be fed to the production unit, and by a camera, which can record images of the packaging units from the higher level that are respectively assigned to the packaging units from the lower level, and by a control means, by way of which the recorded images of the respectively associated packaging units can each be assigned to a common identifier, preferably to a machine-internal counting number of the production unit.

Accordingly, the method of the type mentioned in the introduction is characterized in that a camera records images of the packaging units from the lower level that are to be fed, or have already been fed, to the respective production unit, and a (usually additional, but possibly the same) camera records images of those packaging units from the higher level that are respectively assigned to the packaging units from the lower level, i.e. each comprising the packaging units from the lower level. In addition, the recorded images of the respectively associated packaging units are each assigned to a common identifier. The recorded images are preferably then stored in a data memory, for example a hard disk of a computer, together with the common identifier.

According to the invention, therefore, the common identifier creates assignments between the individual packaging units from different levels without these assignments, as is necessary in the prior art, necessarily having to be gathered from next-higher-packaging-level codings arranged on the packaging units. Neither is it imperative for the codings to be read out. It is also the case that there is no need for the codings, as in the prior art, to be analyzed in the production process and used for generating other codings. The concept according to the invention of recording images of the packaging units from different levels and of linking the images can be realized even at extremely high production speeds and requires only comparatively low levels of computing power.

Alongside this possibility of assigning the individual packaging units from different packaging levels using a comparatively low level of computing power, it is a further advantage of the invention that the recorded images of the packaging units in the production process form a basis for documentation that is optimal for proof-providing purposes.

In order for it to be possible for the respective packaging unit to be identified at a later stage on the respectively recorded image, each respective packaging unit, such as for example each cigarette pack, expediently has applied to it a coding that makes it possible to identify the specific packaging unit. This coding is preferably unique. The term "unique", in this context, relates to the production of at least one batch of the relevant packaging unit. The coding should be used only once at least in this batch, preferably over a number of batches.

In addition to a suitable feature that allows the relevant packaging unit to be identified in such a way, it is also possible, in principle, for the coding to carry further information, for example information regarding the manufacturer of the respective packaging unit, regarding the production unit that has produced the packaging unit, regarding the production date and/or the production time and much more. The images of the packaging units, then, are recorded such that these codings located on the packaging units can each be detected on the images.

As far as the evaluation of the stored images is concerned, said images are expediently analyzed by means of a suitable method. For example, the codings of the packaging units can be read out from the recorded images by virtue of suitable image-recognition software extracting the respective coding automatically from the images and converting it into a usable data form, for example by means of a suitable OCR program. This analysis, advantageously, need not take place in the production process; rather, it can be done downstream as required.

In one embodiment of the invention, the recorded images of the packaging units can be stored and/or archived in the data memory in an unprocessed form. If it is then necessary, at a later point in time, for example to retrace a specific packaging unit from a higher level, the corresponding image of said packaging unit can be retrieved from the data memory and, if appropriate, analyzed. The common identifier assigned to the image then makes it possible to determine, and/or retrieve from the data memory, at any rate the one or more packaging units from the lower level which are assigned to the common identifier.

If the production system has more than two packaging levels, and thus more than two production units, it is possible for example for the images from the first packaging level to be linked with the images from the second packaging level via a first identifier, for the images from the second packaging level to be linked with the images from the third packaging level via a second identifier, and for the images from the third packaging level to be linked with the images from the fourth packaging level via a third identifier, etc. The common identifier used by each production unit may be a local, machine-internal identifier, preferably a counting number. This is generated preferably directly by the production unit and/or the control means of the latter. There is no need here for the respective identifiers of the respective production units to coincide or to be linked with one another in any other way. Using the codings that are contained on the packaging units from the individual packaging levels, and with which at least one unique identification of the respective packaging unit is possible, then nevertheless allows the individual packaging units to be fully retraced over the different packaging levels by suitable analysis of the stored images.

This embodiment with identifiers that are not linked over the packaging levels has the advantage that the respective identifiers and/or information derived therefrom need not be passed on from the one production unit to the next. This embodiment allows particularly high production speeds.

As an alternative, however, it is also conceivable for in each case one and the same common identifier and/or generally linked identifiers to be used over all the packaging levels. Correspondingly, the images of the packaging units from all the packaging levels would then also be linked directly with one another. In order for it to be possible for the identifiers to be linked with one another, it would be possible, for example, for the images of the packaging units from the respectively lower packaging level to be analyzed directly in the process and for the respective codings of the packaging units to be read out therefrom before, or when, said packaging units are packaged in the packaging units from a higher level. On the basis of the codings, which uniquely identify the respective packaging unit, it is then possible to determine the corresponding identifier that was assigned to this coding in the previous packaging level. The identifier determined in this way, or an identifier derived therefrom, can then also be used for the current packaging level.

As far as the recorded images of the packaging units from a lower level are concerned, it is possible to record a single image for each packaging unit. It is usually the case, however, that the packaging units of a plurality, that is to say of a group, of packaging units are recorded together in an image. This is recommended, in particular, when the packaging units, in particular cigarette packs, are arranged in groups in any case in the production unit and/or in conveying processes between the production units. This is the case, for example, when, usually ten, cigarette packs are grouped to form a multipack. Such an image of the cigarette-pack group can be recorded, for example, when the pack group is arranged in the pocket of a turret of the multipacker that produces the multipack.

The images of the packs of the packaging units from the lower level are preferably recorded before, or while, said packaging units are located in the production unit which packages said packaging units in the packaging units from a higher level.

As far as the images of the packs of the packaging units from the higher level are concerned, these are preferably likewise recorded while the respectively associated packaging unit, or the respectively associated packaging-unit group, from the lower level is located in the aforementioned production unit.

For example it is possible, in a multipacker, for a group of cigarette packs to be already wrapped in part, in the packaging of the multipack, that is to say in the correspondingly folded multipack blank, wherein those sides of the cigarette packs that are provided with the codings are still accessible, i.e. are not yet covered over by the corresponding portion of the multipack blank. In this case, it is possible for a camera assigned to the multipacker to register these cigarette-pack sides, for example the undersides thereof, and/or to record a corresponding image and for the same camera, or possibly another camera, to record an image of the multipack, that is to say the multipack blank with the multipack coding arranged thereon.

As an alternative, however, it is also conceivable for the image of the pack of the packaging unit from the higher level to be recorded following completion of the packaging unit from the higher level, that is to say preferably after the packaging unit from the higher level, with the associated packaging unit/packaging-unit group from the lower level, has already left the production unit. In order to make it possible here for the common identifier to be assigned both to the image of the packaging unit, or packaging-unit group, from the lower level and to the image of the associated packaging unit from the higher level, the tracking of the packaging unit, or the packaging-unit group, from the lower level continues during packaging in the production unit until the image of the packaging unit from the higher level is recorded. The continued tracking can take place, for example, by means of a shift register which is assigned to individual conveying elements, in particular conveying pockets or the like, of a conveyor to which the packaging unit, and/or packaging-unit group, from the lower level is assigned during the production operation and, if appropriate, during following conveying operations.

As far as the respective common identifier is concerned, in a particular embodiment of the invention, this is incorporated in each case in the respective, current camera image immediately before, during, or immediately after, the operation of recording the images of the packs of the packaging units, and therefore the identifier is integrated directly in the recorded image, or it is subsequently inserted, by means of suitable software, in the already recorded image. The respectively recorded and/or generated images can then be stored in the data memory together with the incorporated or inserted identifier. However, it is also conceivable for the identifier to be linked with the respective images using customary database technology. In this case, the identifier would be written, in a database, into a field that is linked with the image or images assigned, or to be assigned, to the identifier.

As far as the codings on the packaging units, such as cigarette packs, are concerned, it is possible for these to be arranged already on the pre-produced blanks or, as an alternative, to be applied to the respective packaging unit, such as the respective cigarette pack, by means of a suitable printing unit, during the production process.

In a further embodiment of the invention, in addition, it is possible to record images of packaging units that are to be rejected as defective packaging units from the production process of the production and/or packaging system. Defective packaging units are units that, for whatever reasons, usually on account of lack of quality, are rejected from the actual production process. The images of the defective packaging units here are expediently likewise recorded such that the codings located on, for example, the cigarettes packs of a packaging unit can be detected on the respectively recorded images. The recorded images of the defective packaging units that are to be rejected are then stored for documentation purposes, preferably likewise in the data memory.

As an alternative, it is also possible for the codings on the defective packaging units to be read out directly by means of suitable registering devices, in particular likewise cameras, and, if appropriate, stored in the data memory.

According to a further embodiment of the invention, a cover sensor assigned to a protective cover emits a signal as soon as the protective cover of the production unit, said cover being monitored by the sensor, is opened. When the cover signal occurs, an item of information representing the occurrence of the cover signal is assigned at least to one of those images of packs that are recorded at the point in time when the signal occurs. It is preferable, however, for at least all of the packaging units located in the production unit at this point in time each to be allocated such an item of information. The basis for this measure is that, when the cover is open, it would be possible for packaging units located in the production unit to be exchanged, for example manipulatively, by external packaging units. The assignment of the aforementioned information to said packaging units denotes the latter as being potentially unreliable.

As far as the assignment is concerned, it is possible for the item of information representing the occurrence of the cover signal to be stored in a, or in the aforementioned, data memory for example together with the associated image.

The highest possible safeguard against the aforementioned, manipulative exchange of packaging units is achieved when, when the cover signal occurs, at least all of the packaging units located in the production unit at the point in time when the cover is opened are rejected automatically as defective packs.

In order to allow further protection against manipulation, it is possible for the codings of the packaging units, which identify the packaging units, to be read out during the production process and compared with memory-stored preset values, in particular desired codings.

The read-out operation of the codings can take place by the latter being read out directly in the production process by means of suitable read-out devices. As an alternative, the codings can be read out, in the manner presented above, from the corresponding camera-recorded and data-memory-stored images of the packs of the packaging units.

The packaging units can then be rejected, if appropriate, from the production process in dependence on the aforementioned comparison of the codings with the preset values.

It is thus possible for the read-out codings to be compared, for example, with a number of desired codings stored in the memory. For the case where the respectively read out coding is not contained in the stored number of codings, the packaging unit assigned to the read-out coding can be rejected from the production process.

The comparison with preset values may also involve checking the structure of the read-out codings with reference to the preset values. If the structure does not match a predetermined structure, the packaging units are detected as being "foreign".

Accordingly, the above measures can be used to detect, and if appropriate reject, foreign packaging units, which have been exchanged manipulatively and have an unknown and/or foreign coding.

BRIEF DESCRIPTION OF THE DRAWINGS

Further features of the present invention can be gathered from the attached dependent claims, from the following description of a preferred exemplary embodiment of the invention and from the attached drawings, in which:

DETAILED DESCRIPTION OF PREFERRED EMBODIMENTS

Figure 1:
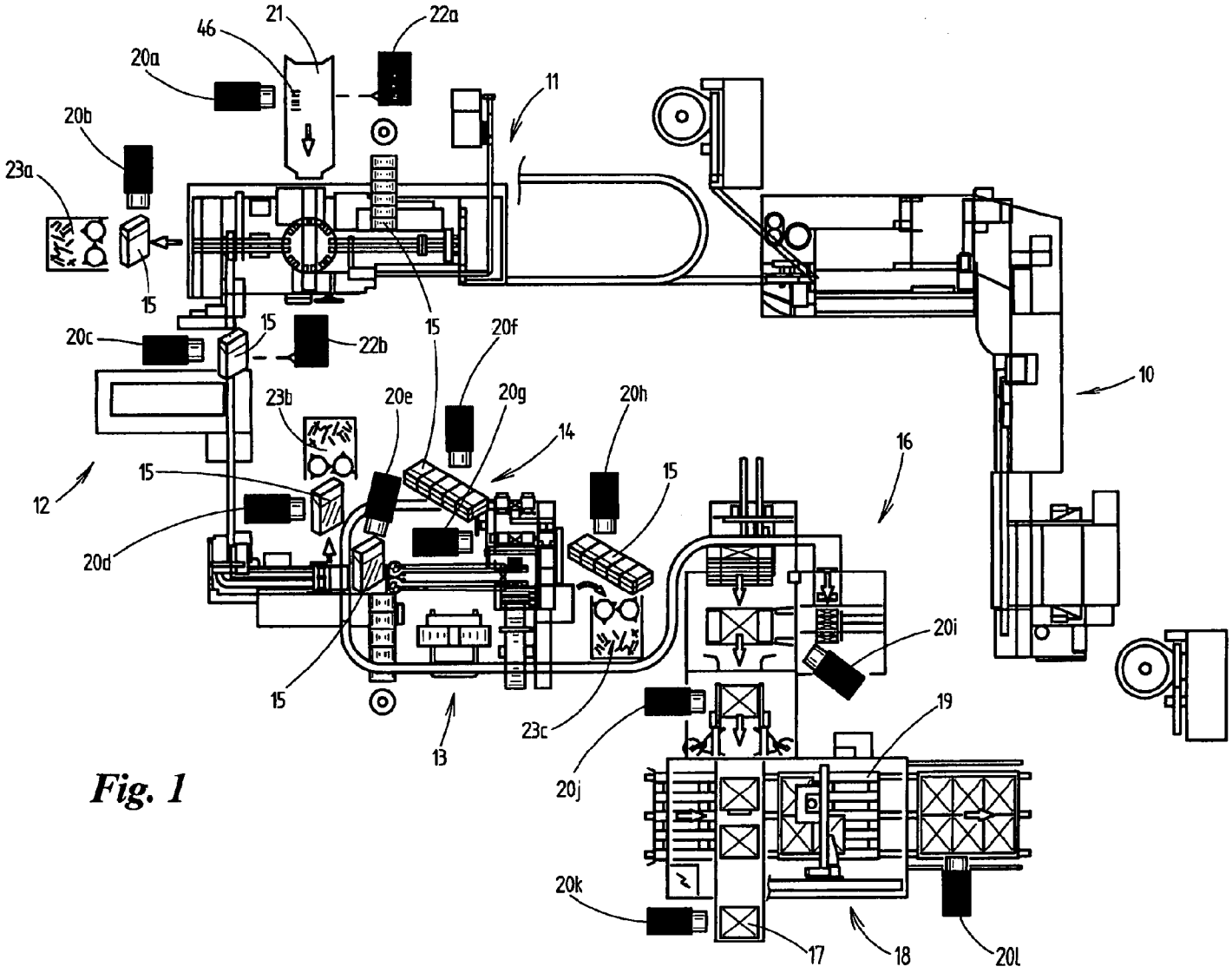
FIG. 1 shows a plan view of a production and packaging system that is intended for producing cigarettes and operates using the method according to the invention.

The exemplary embodiment shown in the drawings relates to a production and packaging system, a so-called production line, for producing and packaging cigarettes.

The system comprises a plurality of production units, that is to say, for example, a cigarette-production machine 10 (a maker), a following packaging machine 11 (a packer), a sheet-wrapping machine 12 (a cellophane wrapper), a packaging machine 13 for producing multipacks 14 from a plurality of cigarette packs 15 (a multipacker), a cartoner 16, which packages the multipacks 14 in shipping cartons 17, and a palletizing robot 18, which positions the cartons 17 in groups on pallets 19.

The individual production units 10, 11, 12, 13, 16, 18 are connected to one another in a manner known per se by suitable conveying apparatuses, for example conveying belts, conveying chains and the like, and therefore production takes place in accordance with the series-production principle. Accordingly, the production units 10, 11, 12, 13, 16, 18 are arranged one after the other in the direction of production flow.

The cigarettes produced by the maker 10 are packaged by the production and packaging system in a number of packaging levels. Packaging units that are produced in a lower packaging level, as seen in relation to the production flow, are packaged by the downstream production unit in each case in packaging units from higher packaging levels.

It is therefore the case that, for example, the "cigarettes" packaging units produced by the maker 10 are packaged, in the packer 11, in the packaging unit from the next-higher packaging level, that is to say in the "cigarette pack" packaging unit. As is known, a plurality of cigarettes are integrated in groups in a respective cigarette pack 15.

The packaging level that comes next in the production sequence is represented by the sheet-wrapping machine 12, in which the individual cigarette packs 15 are wrapped in a respective sheet-material wrapper. In relation to the cigarette packs 15 without a sheet-material wrapper, the wrapped packs 15 form packaging units from a higher level.

The cigarette packs 15 wrapped in this way are then fed, as packaging units from a lower level, to the multipacker 13. In this multipacker 13, usually in each case ten of the cigarette packs 15 are packaged in the packaging unit that is at a higher level than the wrapped cigarette packs 15, that is to say the multipack 14.

The multipacks 14 are then in turn fed, as packaging units from a lower level, to the cartoner 16, which integrates a certain number of multipacks 14 in groups in the packaging unit from the next-higher level, that is to say in the individual cartons 17.

The individual cartons 17, finally, are directed to the palletizing robot 18, which positions the finished cartons in groups on pallets 19, as packaging units from the next-higher level.

It is the case, in principle, that the packaging unit from the next-higher level comprises one or more packaging units from the next-lower packaging level. The expressions "packaging unit from a lower level" and "packaging unit from a higher level", rather than being absolute packaging level descriptions, are exclusively descriptions of a relative nature. It is also conceivable here, in principle, for the "cigarette" packaging unit already to be regarded as a packaging level, in which the tobacco is integrated in the "cigarette" packaging unit.

According to the invention, some of the aforementioned production units 10, 11, 12, 13, 16, 18 of the production and packaging system are assigned cameras 20*a*-20*n*.

These are required, in some cases, in order to realize a control method that makes it possible for individual packaging units to be retraced as required. It is thus conceivable, for example, for it to be necessary for a manufacturer 38 of cigarettes to be able to give proof, in the future, of the cigarette multipack 14 and the carton 17 in which a certain pack 15 was packaged in the production process and/or of the pallet 19 in which it, together with the multipack 14 and the carton 17 in which this was packaged, was shipped.

The camera 20*a*, which is assigned to the packaging machine 11, registers prefabricated blanks 21 for the cigarette packs 15 produced in the packaging machine 11. In the present exemplary embodiment, the cigarette packs 15 are hinge-lid boxes. The blanks 21 each have at least one coding 46. The camera 20*a* is arranged such that the images each recorded of the blanks 21 by the camera 20*a* each also show the coding 46. The prefabricated blanks 21 may already be prefabricated with the codings 46. As an alternative, it is also conceivable for the codings 46 to be applied, by means of a printing unit 22*a*, only in the production process.

The further camera 20*b* assigned to the packaging machine 11 records images of individual cigarette packs 15 that are already partially or wholly completed in the packaging machine 11 and are rejected as defective packs from the packaging process of the packaging machine 11, for example because they do not meet predetermined desired quality values. The camera 20*b* here is arranged along a removal route, along which the defective packs are rejected from the packaging machine 11. In the present case, the defective packs are fed, via the removal, to a shredder 23*a* in order to be destroyed.

As seen in relation to the production flow, the camera 20*c* is arranged immediately upstream of the sheet-wrapping machine 12. It registers the incoming cigarette packs 15 produced by the packaging machine 11.

As seen in the process direction, the camera 20*e* is arranged downstream of the sheet-wrapping machine 12, but upstream of the multipacker 13 that follows. It registers the cigarette packs 15 that are produced by the sheet-wrapping machine 12 and are conveyed in the direction of the multipacker 13.

For packs 15 that the sheet-wrapping machine 12 rejects as defective packs, the camera 20*d* is arranged along a corresponding removal route of the packs 15 and can record images of the defective packs, which are fed to a shredder 23*b* via the removal route.

In addition to the camera 20*e*, the multipacker 13 is assigned the three further cameras 20*f*, *g* and *h*. In the manner that will be described in more detail at a later stage in the text with reference to FIG. 2, the cameras 20*g* and 20*f* record images of the cigarette packs 15 and of the partially finished multipack 14. The camera 20*h* is arranged along a removal route for defective multipacks, in order to register rejected multipacks 14 before these are fed to a shredder 23*c*.

The cartoner 16 is assigned three cameras 20*i*, 20*j*, 20*k*. The camera 20*i* registers the multipacks 14 as they are being pushed into the cartoner 16. The camera 20*j* registers the finished cartons 17 as they leave the cartoner 16. The camera

20*k* is arranged along a corresponding removal route in order to register those cartons that are rejected as defective cartons.

The palletizing robot 18 is assigned the camera 20*l*, which registers the individual pallets 19 on which the individual cartons 17 are arranged in groups.

All of the cameras 20*a*-201 are oriented such that they can each register the codings that are applied to the individual registered packaging units and/or blanks, and identify the packaging units/the blanks.

The cameras form part of an overall system that, as already mentioned, allows the individual packaging units from different packaging levels to be retraced as required.

The progression of the method according to the invention and/or of the system according to the invention will be explained in more detail with reference to the multipacker 13, which is illustrated in detail in FIG. 2.

The multipacker 13 corresponds essentially to the apparatus according to DE 100 00 798 A1. According to said document, the multipacker 13 comprises two folding sub-assemblies, that is to say a first folding turret 25 and a second folding turret 26. These are each provided with pockets 27, 28 for accommodating pack groups 43 made up of two rows, arranged one above the other, of in each case usually five cigarette packs 15. The production process is initiated in the region of the upper folding turret 25, which rotates about a horizontal axis.

In a pushing-in station 34, the pack contents, that is to say the pack group 43, is supplied on a horizontal panel 29 and pushed by a pusher 30 from the platform 29 and into the pocket 27 supplied. A respective multipack blank 24 for forming the packaging or outer wrapper of the multipack 14 is supplied transversely to the pushing-in direction. The multipack blank 24 is intercepted in the customary manner by the pack group 43, made up of packs 15, and pushed into the pocket 27 therewith, being folded in a U-shaped manner in the process. The pushing-in operation is facilitated by a mouthpiece 32 formed from upper and lower shaped components.

Figure 2:
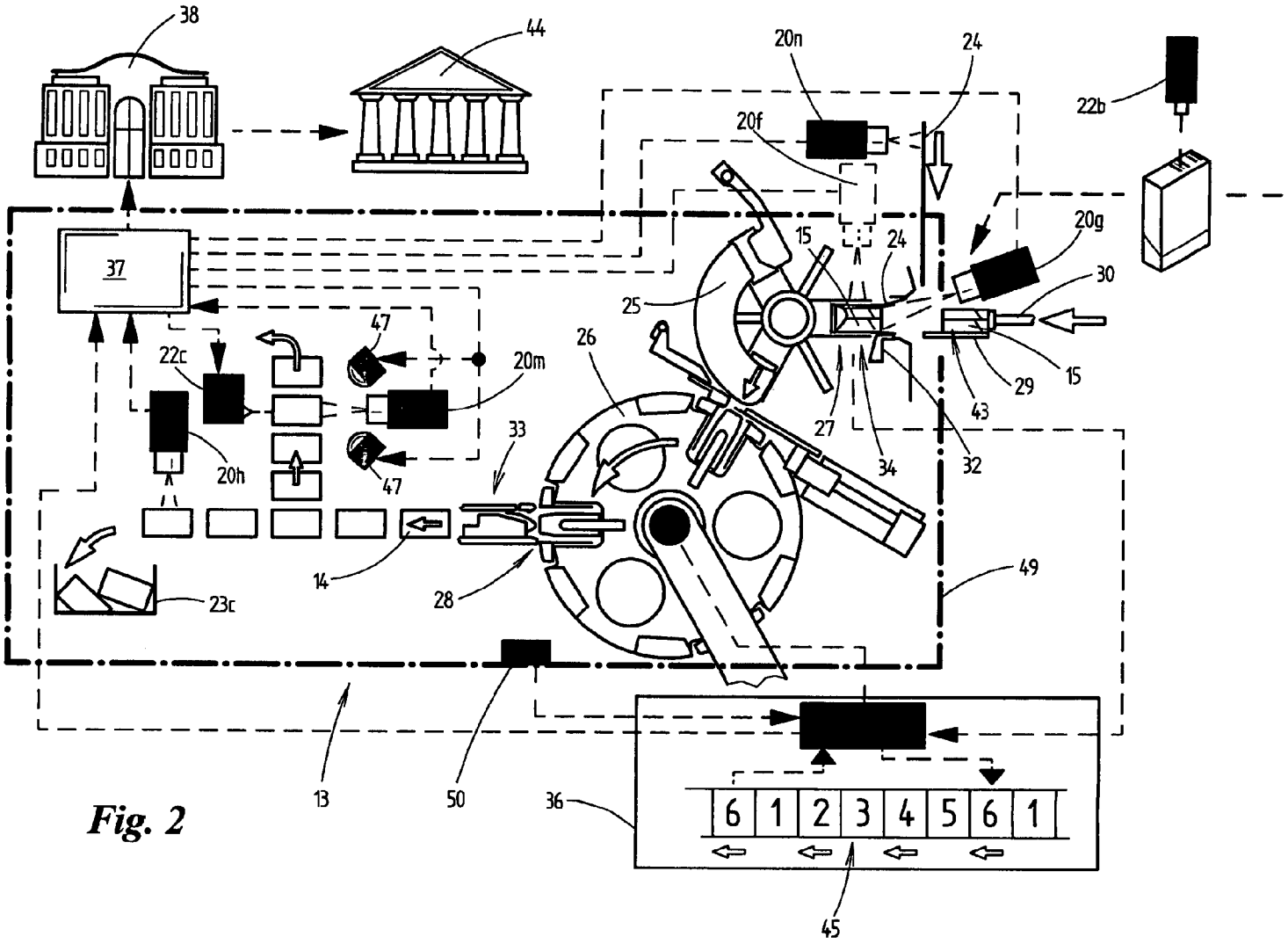
FIG. 2 shows the use of the method according to the invention in relation to one of the production units of the production and packaging system that are shown in FIG. 1, that is to say in relation to a multipacker.

In that position of the pack group 43 within the pocket 27 which is shown in FIG. 2, the radially outwardly oriented side surfaces of the individual packs 15 are exposed, i.e. they are not covered over by walls of the pocket 27 or by the multipack blank 24. In the present exemplary embodiment, these side surfaces are formed by the undersides of the packs 15.

A respective coding 39 is arranged on these undersides. The codings 39 have been applied beforehand in the production process by a printing unit 22*b*, which is arranged between the packaging machine 11 and sheet-wrapping machine 12. They allow, in particular, the unique identification of the respective cigarette pack 15. In addition, it is also possible for the coding to contain information regarding the date and the time of manufacture of the cigarette packs 15, regarding the machine used to produce the packs 15, and much more.

The multipack blank 24 covers over the upper side, the underside and the radially inwardly oriented side of the pack group 43. The camera 20*g*, which is assigned to the multipacker 13, is designed, and positioned, such that, with the pack group 43 in the position shown, it can record in an image 41 the outwardly oriented sides of all the packs 15 of the pack group 43 together with the codings 39 arranged thereon.

In addition, according to a variant of the invention, in this position the further camera 20*f*, which is assigned to the multipacker 13, registers the upwardly oriented side of the multipack blank 24. The registering operation takes place in a region of the multipack blank 24 in which is arranged a coding 40, which identifies the respective multipack 14. This coding 40 has already been printed on the prefabricated multipack blanks 24.

As production progresses, in a manner known per se, the pack group 43 in the pocket 27 is rotated one increment further by virtue of the folding turret 25 being rotated. Various folding operations are known per se, and will not be discussed in any more detail here, take place in the folding turret 25. Thereafter, the multipack contents, that is to say the pack group 43, are fed to the second folding turret 26 together with the partially or already definitively folded multipack blank 24. Said second folding turret transports the multipack 14, finally, to a removal station 33. The individual multipacks 14 are then conveyed further along a conveying route in the direction of the cartoner 16.

Figure 3A:
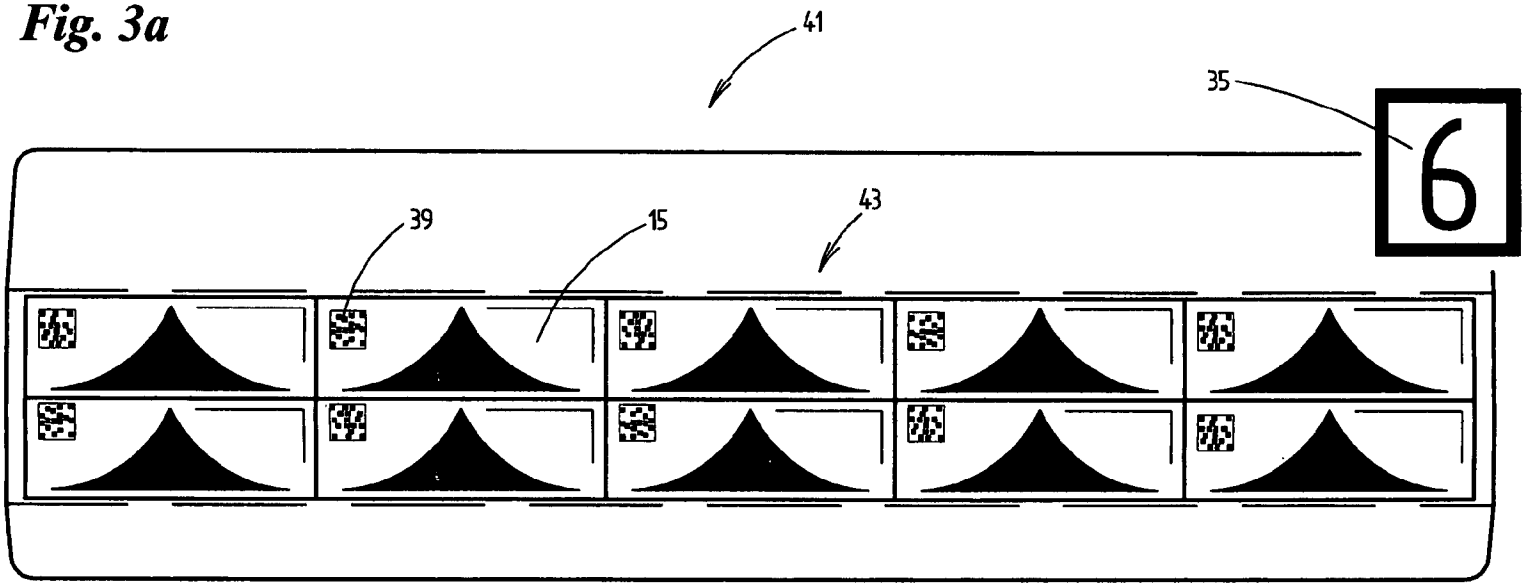
FIG. 3*a* shows an image of a group of cigarette packs in a multipack blank.
Figure 3B:
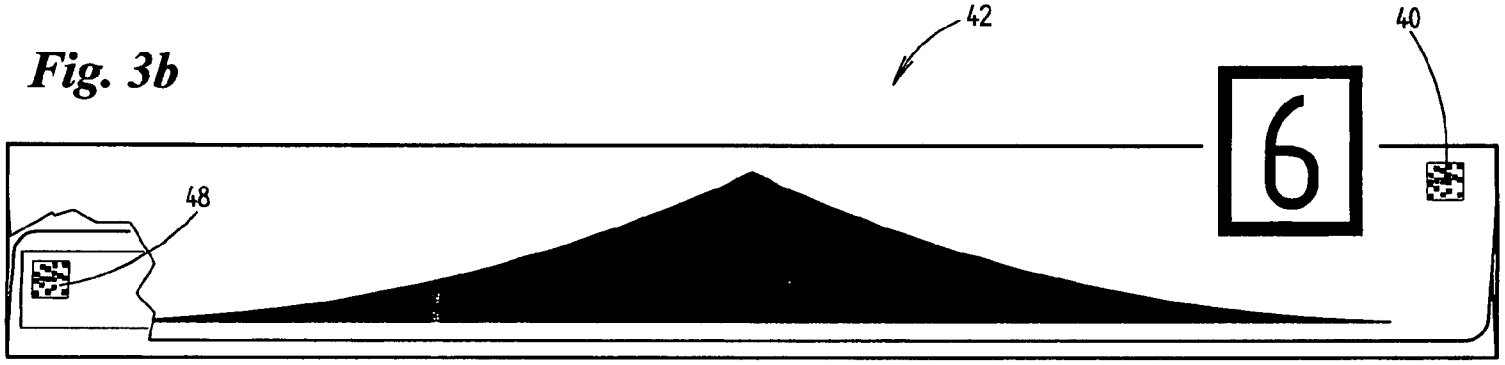
FIG. 3*b* shows an image of the cigarette packs from FIG. 3*a* with the multipack completed.

The images 41 of the group 43 of packs 15, which are recorded by the camera 20*g*, are shown in FIG. 3*a*. The images 42 of the multipack blank 24, which are recorded by the camera 20*f*, are illustrated in FIG. 3*b*.

Corresponding image pairs 41, 42 are recorded of each pack group 43 pushed into the respective pocket 27 in the pushing-in station 34 during the production process and of each associated multipack blank 24. When each image 41, 42 is recorded, a respective unique identifier 35, allocated by the multipacker 13, is incorporated both in the image 41 of the pack group 43, this image being generated by the camera 20*g*, and in the image 42 of the multipack blank 24 that wraps the pack group 43. In the present case, this identifier is a counting number.

The identifier 35 is the same for both images 41, 42; accordingly, it is an identifier 35 that is common to both images. The identifier 35 here is generated machine-internally by the multipacker 13 or by the control means 36 of the multipacker 13.

According to the invention, the next-to-be-packaged pack group 43, which is pushed into the corresponding pocket 27 of the folding turret 25 in the pushing-in station 34 during the following machine cycle of the multipacker 13, and the corresponding next multipack blank 24, in which the next pack group 43 is wrapped, are given an identifier 35 that differs from the previous identifier 35 and from all the identifiers 35 that have gone before. Therefore, in each case another common identifier 35 is incorporated in the two images 41, 42 of the next pack group 43 and of the next multipack blank 24, assigned to the pack group 43.

In an extremely straightforward realization of the invention, in which the identifier 35, as in the present case, is in the form of a counting number, it is possible for the identifier 35 of the next image pair 41, 42 to be increased just by the value of one in relation to the identifier 35 of the preceding image pair 41, 42.

It is, of course, possible to use any kind of identifier, as long as the respective identifiers are unique. The uniqueness here relates preferably at least to the production of a batch of the product which is to be produced in the multipacker 13 and/or, if appropriate, of the product that is to be produced in the production system.

The machine-control means 36 of the multipacker 13 ensures that the images generated by the camera 20*g* and by the camera 20*f* are directed to an external PC 37. This external PC 37 temporarily stores every image of every pack group 43 recorded in the manner presented, and of every multipack blank 24, in a corresponding data memory, for example on a suitable hard disk.

The images 41, 42 recorded during the course of the production process can be evaluated immediately or at a later point in time. For example, it is possible for the cigarette manufacturer 38 to access the stored data as required and to communicate the same, if required, to a higher authority 44.

The images 41, 42 are as yet unevaluated, and/or still awaiting analysis, in the stored form in each case. In particular, the codings 39, 40 have not yet been read out. If, for example, the authority 44 requires the manufacturer 38 to give proof of the specific cigarette packs 15 packaged in a certain multipack 42, it is possible to analyze the images stored in the memory or, if appropriate, in a suitable database. Using suitable image-recognition methods, the codings 39 of the cigarette packs and/or the codings 40 of the multipacks 14, and/or the identifiers 35 of the respective images, can be extracted from all the recorded images 41, 42 and read out. The identifiers 35 can then be used to determine the respective packs 15 which were packaged in a specific multipack 14 during production. This is because the respective packs 15 and the corresponding multipack 14 are each assigned the same, identical identifier 35.

As an alternative to the image 42 of the multipack 14 being recorded, as described above, by the camera 20*f* in the region of the pushing-in station 34, it is also possible for the image 42 of the multipack blank 24 or of the multipack 14 to be recorded following completion of the multipack 14. It is thus possible to arrange, for example, a camera 20*m* along the conveying route along which the multipacks 14, following completion, are conveyed to the cartoner 16. Like the camera 20*f* in the embodiment described above, the camera 20*m* then generates images 42 of the multipacks 14.

The images include at least the region of the multipack codings 40. In order for it to be possible in this case to incorporate, in the respective image 42, the same identifier 35 as was incorporated in the image 41 of the pack group 43, this image having been recorded beforehand in the pushing-in station 34, it is necessary to continue tracking the position of the corresponding pack group 43 as it runs through the multipacker 13. This can be done, for example, by means of a suitable shift register 45 that is assigned to the corresponding conveying devices or conveying pockets, by means of which the multipack blank 24 together with the pack group 43, or the partially and then fully completed multipack 14, is conveyed further. Accordingly, at the position of the camera 20*m*, the control means 36 of the multipacker 13 knows which pack group 43 is being currently recorded in each case and which identifier 35 has been allocated to this pack group 43 beforehand when it was registered by the camera 20*g* in the pushing-in station 34. The same identifier 35 is then incorporated in the image 42 of the currently recorded multipack 14.

In a modification of the aforementioned alternative, it is also possible to use prefabricated multipack blanks 24 that, as yet, do not have any coding 40. In this case, said coding 40 can be applied to the multipack 14, by means of a printing unit 22*c*, for example just prior to the image 42 being recorded by the camera 20*m*.

Multipacks 14 that are conveyed out of the production process as defective packs that do not fulfill predetermined quality measures, or as defective multipacks, are registered by the camera 20*h* before being fed to the shredder 23*c*. The camera 20*h* here records images of the corresponding multipacks 14 that each show the coding 40 of the multipacks 14. It is also possible, in a manner similar to that described above in conjunction with the images recorded by the camera 20*m*, to incorporate in the images of said multipacks 14, in principle, the same identifier 35 that has been incorporated beforehand in the image of the pack group 15 located in the multipack 14. This is not imperative, however. The generated images are likewise transmitted to the PC 37 and can therefore be analyzed and/or evaluated by the manufacturer 38. In particular, the codings 40 have to be extracted from the images and read out.

As an alternative, it is further conceivable for the codings 40 of these defective multipacks also to be read out, and processed, directly during the reject operation, without images of the defective multipacks having first to be recorded beforehand.

All the packaging levels of the production and packaging system can be controlled in a manner analogous to that described above for the multipacker 13. It is thus possible for basically all the production units 10, 11, 12, 13, 16, 18, which are fed packaging units from a lower level and integrate these in a packaging unit from a higher level, for the corresponding cameras to record images of the packs of the packaging unit from the lower level and images of the associated packs from the higher level and for these images to be assigned to a common identifier by the control means.

This makes it possible to retrace the packaging units over all the packaging levels or selected packaging levels. It is, of course, conceivable to remove one or more packaging levels from consideration, for example if retraceability is neither desired nor necessary for the respective packaging level.

FIG. 2 also shows a protective cover 49, which protects the multipacker 13 against unauthorized intervention. This protective cover 49 is assigned a sensor 50. This sensor 50 emits a signal to the control means 36 of the multipacker 13 as soon as the protective cover is opened. According to an alternative of the invention, it is provided that, for safety-related reasons, once the protective cover 49 has been opened, all the completed or partially completed multipacks 14 within the multipacker 13 are rejected as defective multipacks. The basis for this is the risk that individual multipacks 14 could be manipulatively exchanged once the protective cover 49 has been opened.

As an alternative, it is conceivable, when a cover signal occurs, for a respective item of information representing the occurrence of the cover signal to be assigned at least to those images 41 and/or 42 of those multipacks 14 and/or cigarette packs 15 that are recorded at the point in time when the signal occurs. It is expediently the case, however, that all the half-finished and finished multipacks 14 and/or cigarette packs 15 that are located within the multipacker 13 at the point in time when the signal occurs are determined and the aforementioned information is respectively assigned correspondingly to the images 41, 42 of all the multipacks 14 or cigarette packs 15 determined.

The assignment of the information can take place by in each case a corresponding additional identifier, or a corresponding additional feature, for the individual images 41, 42 being stored in the memory of the PC 37. This allows the multipacks 14, to be identified in the later analysis by the manufacturer 38 as potentially unreliable and/or potentially manipulated.

A further special feature of the invention, which can also be claimed in its own right, will be described hereinbelow. Production and packaging systems for cigarettes and/or individual production units of the same are assigned controllable devices, for example checking devices and/or illuminating devices or the like. These devices frequently have to be, or should be, adjusted differently, in dependence on the blanks used in each case, for example pack blanks, revenue stamps, sheets or the like.

Blanks are illuminated by illuminating devices, for example during the production process, and the blanks illuminated in this way are registered by means of optical checking devices, for example cameras. Depending on the blank used, it may be expedient to expose the blank here to light of different wavelengths. If a region of a blank which is to be checked is, for example, red, the region which is to be registered by the camera should be exposed, by the corresponding illuminating device, to a light of a different color than is the case for a blank in which the region to be checked is, for example, green.

In order to control the respective controllable devices of a production unit in dependence on the blanks used, it is provided for the blanks each to have arranged on them a coding that can be read out in the production process. At least one controllable device, in particular an illuminating device and/or a checking device, is then controlled in accordance with, and/or in dependence on, the read-out coding. The coding that is to be read out is advantageously arranged at a position of the blank that, with the respective packaging unit completed, can no longer be detected from the outside.

In the case of the production and packaging system shown in FIGS. 1-3, for example the prefabricated cigarette-pack blanks 21 are provided with a corresponding coding 46. Either the codings 46 are already present on the prefabricated blanks 21 before the latter are introduced into the production process. In this case, the codings 46 are read out by the camera 20*a*. As an alternative, the codings 46 are applied by the printing unit 22*a*. Corresponding devices of the production and packaging system can then be controlled in dependence on said codings 46. It is possible to adjust, for example, parameters of the cameras 20*b*, 20*c*, 20*d*, 20*e*, 20*g* that register the blanks 21, or the cigarette packs 15 produced therefrom, and/or record images of the same.

It is similarly possible for illuminating devices 47, which illuminate the cigarette multipacks 14 while the camera 20*m* records the images 42 of the multipacks 14 in the manner described above, to be adjusted in dependence on codings 48, which are applied to the multipacks 14. These codings 48 can be read out, for example, by means of a camera 20*n*, which registers the individual multipack blanks 24 in the region of the pushing-in station 34 of the multipacker 13 while the blanks 24 are being fed to said pushing-in station 34. The light wavelength to which the multipacks 14 are exposed by the illuminating devices 47 is adjusted in accordance with the codings 48. The codings 48 are arranged in a region of the multipack blank 14 that, with the multipack 14 finished, cannot be detected from the outside, cf. FIG. 3*b*.

Yet a further special feature of the invention, which can likewise be claimed in its own right, will be described hereinbelow.

Accordingly, it is provided for one or more test products, in particular test packaging units and/or test blanks, to be introduced into the production process of a production unit or of a production and/or packaging system. The test products should have one or more defined faults, for example incorrect printing, incorrect dimensions or the like. They have a read-out coding that identifies them as test products.

The test products serve for testing one or more checking apparatuses and/or checking methods of the production unit or of the system. Such checking apparatuses are used to check for quality defects or the like in the products produced in the production process.

A read-out unit that can read out the aforementioned coding of the test product is arranged in the production process downstream of the checking apparatus that is to be checked by the test product.

If the checking apparatus is operating correctly, the test product introduced is detected by the checking apparatus on the basis of the fault being coordinated with the checking apparatus. As may also be the case after a regular defective product has been detected, the checking apparatus then rejects the test product, if appropriate, from the production process.

However, if the checking apparatus is not operating correctly, the fault of the test product is possibly not detected by the checking apparatus. The test product is not rejected from the production process. In this case, the test product passes to the read-out unit downstream. This reads out the coding of the test product.

On the basis of the coding, the control means of the production unit or of the production and/or packaging system detects the test product as being such and generates a fault message. The fault message, finally, is an indication of the checking apparatus not operating properly, or operating defectively.

If a checking apparatus that is to be tested is used to check, for example, revenue stamps of cigarette packs, it would be possible to introduce a test cigarette pack with a coding identifying it as a test pack. The revenue stamp of the test pack would have a fault coordinated with the checking apparatus, for example it would be skewed in position.

Should the checking apparatus, for checking the revenue stamp, detect the fault, that is to say the skewed positioning of the revenue stamp, the test cigarette pack, like any pack having a revenue-stamp fault, is rejected automatically from the production process.

Should the checking apparatus, however, be operating defectively, the fault of the test pack is not detected. The test pack therefore remains in the production process. The coding that identifies the test pack is then read out by means of a downstream read-out unit, for example a camera.

On the basis of the coding, the control means of the production unit or of the production and/or packaging system recognizes that the pack assigned to the read-out coding is a test pack that is still located in the production process, although it would already have been rejected were the checking apparatus operating correctly. The control means can then generate a fault message and the checking apparatus can be serviced and/or repaired.

LIST OF DESIGNATIONS

10 Cigarette-production machine
11 Packaging machine
12 Sheet-wrapping machine
13 Packaging machine
14 Multipack
15 Cigarette pack
16 Cartoner
17 Shipping carton
18 Palletizing robot
19 Pallet
20*a*-20*n* Camera
21 Blank
22*a*-22*c* Printing unit
22*b* Camera
23*a* Shredder
23*b* Shredder
23*c* Shredder

24 Multipack blank
25 Folding turret
26 Folding turret
27 Pocket
28 Pocket
29 Panel
30 Pusher
32 Mouthpiece
33 Removal station
34 Pushing-in station
35 Identifier
36 Machine-control means
37 PC
38 Manufacturer
39 Coding
40 Coding
41 Image
42 Image
43 Pack group
44 Authority
45 Shift register
46 Coding
47 Illuminating devices
48 Coding
49 Protective cover
50 Sensor

The invention claimed is:

1. A method for producing and/or packaging products, namely cigarettes, in a production and/or packaging system, comprising:

feeding packaging units from a lower packaging level (15) to at least one production unit (13) of the system, wherein the at least one production unit (13) packages said packaging units in associated packaging units from a higher packaging level (14), whereby the packaging units from the higher level (14) each comprise at least one of the packaging units from the lower level (15);

recording, with a camera (20*g*), images of the packaging units from the lower level (15) that are to be fed, or have already been fed, to the at least one production unit (13);

recording, with a camera (20*f*, 20*m*), images of the packaging units from the higher level (14) that are respectively assigned to the packaging units from the lower level (15); and assigning a common identifier to the recorded images (41, 42) of the associated packaging units from the higher level (14) and form the lower level (15).

2. The method as claimed in claim 1, wherein a single image is recorded for each of the packaging units from the lower level (15), or a joint image (41) is recorded for a group (43) of packaging units from the lower level (15).

3. The method as claimed in claim 2, wherein the images (41) of the packaging units from the lower level (15) are recorded before, or while, the packaging units from the lower level (15) are located in the production unit (13).

4. The method as claimed in claim 3, wherein the images (42) of the packaging units from the higher level (14) are likewise recorded while the associated packaging unit or the associated packaging-unit group (43) from the lower level (15) and the packaging units from the higher level (14) are located in the production unit (13).

5. The method as claimed in claim 4, further comprising tracking the packaging unit or the packaging-unit group (43) from the lower level (15), the tracking continuing during packaging of the packaging unit or the packaging-unit group in the production unit (13), and recording the image (42) of the associated packaging unit from the higher level (14) after the associated packaging unit from the higher level (14) has left the production unit (13) following completion of the combining of the packaging unit from the higher level (14) with the associated packaging unit or packaging-unit group (43).

6. The method as claimed in claim 3, wherein the images (41) of the packaging units from the lower level (15) are recorded before, or while, the packaging units from the lower level (15) are located, in groups, in a conveying device (27) of a conveying apparatus (25) of the production unit (13).

7. The method as claimed in claim 3, wherein the images (41) of the packaging units from the lower level (15) are recorded before, or while, the packaging units from the lower level (15) are located, in groups, in a conveying pocket (27) of a turret (25) of the production unit (13).

8. The method as claimed in claim 2, wherein the images (41, 42) of the packaging units (14, 15) are recorded so as to be able to detect codings (39, 40) on the recorded images (41, 42), the codings (39, 40) being located on and identifying the packaging units.

9. The method as claimed in claim 8, wherein the codings (39, 40) are applied to the respective packaging unit by a system-specific printing unit (22*a*, 22*c*), the codings (39, 40) being applied to the respective packaging unit during operation of the production and/or packaging system.

10. The method as claimed in claim 8, further comprising recording the images of the packaging units (14, 15) that are to be rejected as defective packaging units from the production process of the production and/or packaging system, detecting the codings (39, 40) on the recorded images (41, 42), which codings are located on and identify the packaging units (14, 15), and storing the recorded images of the defective packs that are to be rejected in the data memory.

11. The method as claimed in claim 8, further comprising analyzing the recorded images (41, 42) of the codings (39, 40) of the packaging units (14, 15) by extracting the codings (39, 40) from the recorded images (41, 42), and reading out the codings (39, 40) by a text- and/or image-recognition method.

12. The method as claimed in claim 1, wherein the packaging units from the lower level (15) are selected from the group consisting of:

cigarette packs that are fed from a packaging machine (11) of the production and/or packaging system, wherein the packaging units from the higher level are sheet-material blanks that are fed to a sheet-wrapping machine (12) in the production and/or packaging system, or the packaging units are multipack blanks (24) that are fed to a multipacker (13) of the production and/or packaging system, wherein the cigarette packs (15) are wrapped in groups, cigarette multipacks that are fed to a cartoner (16) of the production and/or packaging system, wherein the packaging units from the higher level are carton blanks, the cigarette multipacks (14) are packaged in groups, and cartons (17) that are fed to a palletizer (18) of the production and/or packaging, wherein the packaging units from the higher level are pallets (19) on which the cartons (17) are positioned in groups.

13. The method as claimed in claim 1, wherein the common identifier (35) is a machine-internal counting number of the production unit (13).

14. The method as claimed in claim 2, wherein the recorded images (41, 42) of the packaging units from the higher and the lower packaging levels (14, 15) are each stored with an associated common identifier (35) in a data memory assigned to a computer.

15. The method as claimed in claim 14, wherein the common identifiers (35) of each of the images (41, 42) are each incorporated into the respective camera image (41, 42) immediately before, during, or immediately after, the step of recording the images (41, 42) of the packaging units (14, 15), and wherein the respectively recorded images (41, 42) are stored together with the incorporated or inserted identifier (35).

16. The method as claimed in claim 14, further comprising assigning a cover sensor (50) to a protective cover (49) for the production unit (13) and monitoring the protective cover (49) with the cover sensor (50), wherein the cover sensor (50) emits a signal when the protective cover (49) is opened, and, when the cover signal is emitted, the packaging units (14, 15) located in the production unit (13) when the protective cover (49) is opened are automatically rejected as defective packs.

17. The method as claimed in claim 14, further comprising assigning a cover sensor (50) to a protective cover (49) for the production unit (13) and monitoring the protective cover (49) with the cover sensor (50), wherein the cover sensor (50) emits a signal when the protective cover (49) is opened, and, when the cover signal is emitted, an item of information representing the cover signal is assigned at least to one of the recorded images (41, 42) recorded at the point in time when the cover signal is emitted.

18. The method as claimed in claim 17, wherein the information representing the emitted cover signal is stored in the data memory together with the associated image (41, 42).

19. The method as claimed in claim 14, wherein each of the packaging units includes codings (39, 40) to identify the packaging units (14, 15), and further comprising reading out the codings (39, 40) during the production process, comparing the read-out codings (39, 40) with preset values stored in the data memory, and rejecting the packaging units (14, 15) from the production process based on the comparison to the preset values.

20. The method as claimed in claim 19, wherein the read-out codings (39, 40) are compared with a number of stored desired codings, and when the read-out coding (39, 40) is not contained in the number of stored codings (39, 40), rejecting the packaging unit (14, 15) assigned to that includes the read-out coding (39, 40) from the production process.

21. The method as claimed in claim 19, wherein the data-memory-stored preset values are desired codings.

22. A production system for implementing the method as claimed in claim 1, comprising:

at least one production unit (13) to which the packaging units from the lower level (15) are fed, wherein the packaging units are packaged by the production unit (13) into associated packaging units (14) from the higher level, whereby the packaging units from the higher level (14) comprise at least one packaging units (15) from the lower level, a camera (20*g*) for recording the recorded images (41) of the associated packaging units from the lower level (15), a camera (20*f*, 20*m*) for recording the recorded images (42) of the associated packaging units from the higher level (14) that are respectively assigned to the packaging units from the lower level (15), and a control means (36) for assigning a common identifier (35) to the recorded images (41, 42) of the respectively associated packaging units (14, 15).

23. The production system as claimed in claim 22, wherein the common identifier (35) is a machine-internal counting number of the production unit (13).

* * * * *